US007459626B2

(12) United States Patent
Yoshino et al.

(10) Patent No.: US 7,459,626 B2
(45) Date of Patent: Dec. 2, 2008

(54) APPARATUS AND METHOD FOR DETECTING DISPLACEMENT OF A MOVABLE MEMBER OF AN ELECTRONIC MUSICAL INSTRUMENT

(75) Inventors: Kiyoshi Yoshino, Hosoe-cho (JP); Kazuhiro Arai, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 272 days.

(21) Appl. No.: 10/982,116

(22) Filed: Nov. 5, 2004

(65) Prior Publication Data

US 2006/0096448 A1 May 11, 2006

(51) Int. Cl.
*G10H 3/00* (2006.01)

(52) U.S. Cl. ..... 84/723; 84/725; 84/730; 84/733; 84/734

(58) Field of Classification Search ..... None
See application file for complete search history.

(56) References Cited

U.S. PATENT DOCUMENTS 5,474,289 A * 12/1995 Pilling ..... 271/265.04
5,872,416 A * 2/1999 Nogarede ..... 310/323.03
2004/0262957 A1* 12/2004 Young et al. ..... 297/217.3
2005/0145101 A1* 7/2005 Yoshino ..... 84/723
2005/0145102 A1* 7/2005 Susami ..... 84/735
2005/0150349 A1* 7/2005 Susami ..... 84/299
2006/0099559 A1* 5/2006 Kohl et al. ..... 434/265
2006/0139667 A1* 6/2006 Morimoto et al. ..... 358/1.9
2006/0156910 A1* 7/2006 Yoshino ..... 84/723

FOREIGN PATENT DOCUMENTS

JP 04-014793 1/1992
JP 09-097075 4/1997
JP 2004-94036 * 3/2004

* cited by examiner

*Primary Examiner*—Marlon T Fletcher
(74) *Attorney, Agent, or Firm*—Foley & Lardner LLP

(57) ABSTRACT

An apparatus for detecting the displacement of a movable member of an electronic musical instrument. The apparatus has superior mechanical durability compared to displacement sensors of the past and can withstand long-term use. The apparatus includes a sensor that provides a detectable electrical characteristic having a value and a spring that, when compressed upon displacement of the movable member acts with the sensor, causing the value of the electrical characteristic to change. The value of the electrical characteristic represents the amount of displacement of the movable member and is used by a controller of the electronic musical instrument.

27 Claims, 8 Drawing Sheets

APPARATUS AND METHOD FOR DETECTING DISPLACEMENT OF A MOVABLE MEMBER OF AN ELECTRONIC MUSICAL INSTRUMENT

BACKGROUND OF THE INVENTION

1. Field of the Invention

The present invention relates, generally, to electronic musical instruments and, in preferred embodiments, to electronic musical instruments having the capability of detecting the amount of displacement of a pedal or of other movable members.

2. Description of Related Art

In electronic musical instruments, displacement sensors are used as sensors to detect the amount of displacement of, for example, a pedal.

Examples of prior methods for the detection of the amount of displacement are described below.

Method 1: This is a method in which, for example, a displacement sensor is configured with a rubber sensor that changes shape in conformance with the amount that a pedal is stepped on and a sensor sheet that is pressed by the rubber sensor as the rubber sensor changes shape. The resistance value of the sensor sheet changes in conformance with the area of the sheet that is pressed.

Method 2: This is a method in which the resistance value of a volume control changes in conformance with the amount that a pedal is stepped on.

The determination of the amount of displacement is possible with the use of any of the methods discussed above. However, in those cases where the displacement of a pedal is detected, the displacement sensor is required to have the durability to withstand the force that is repeatedly applied from the pedal over a long period of time. Each of the methods mentioned above has problems such as those described below.

In Method 1, when the rubber sensor is used over a long period of time and its shape is repeatedly changed in conformance with the stepping operation of the pedal, the rubber sensor becomes deformed in shape such that it becomes impossible to accurately detect the amount that the pedal has been stepped on.

In Method 2, when the volume control is used for a long period of time, the mechanical sliding portion is abraded and that becomes a problem.

SUMMARY OF THE DISCLOSURE

Therefore, it is an advantage of embodiments of the present invention to provide an apparatus and method for providing a displacement sensor that has superior mechanical durability and that can withstand use over a long period of time.

An embodiment of the present invention that achieves the object described above is characterized in that the displacement sensor is furnished with a sensor structure, such as a sensor sheet, for which the resistance value changes in conformance with the area that has been pressed and a coil spring that has a conical shape. The wider end of said conical shape is in contact with the previously mentioned sensor sheet and increases the area of pressing of said sensor sheet in proportion to the compression of the spring.

The coil spring with which an embodiment of the present invention is furnished possesses durability with respect to the compression force that is received from the object that is displaced. In addition, since the displacement sensor is furnished with a structure in which the mechanical rubbing portion that is the cause of abrasion is excluded, the mechanical durability is superior and long-term use is possible.

In addition, it is preferable that an embodiment of the present invention be one in which the above mentioned sensor sheet is furnished with a sheet material that possesses electrical conductivity and with an electrode pattern that is disposed opposite the previously mentioned sheet material and is formed by radial segments extending between the center of the sensor sheet and its periphery.

The direction over which the cone shaped coil spring presses the sensor sheet as the spring is compressed is from the outer periphery of the sensor sheet toward the center of the sensor sheet. The degree to which the spring presses the sensor sheet is in proportion to the compression of the coil spring. Since the electrode pattern described above is formed along the direction over which the spring presses the sensor sheet, the resistance value of the above mentioned sensor sheet changes with good efficiency due to the compression of the coil spring.

As has been explained above, an embodiment of the present invention is superior in mechanical durability compared to the displacement sensors of the past and can withstand use for a long period of time.

These and other objects, features, and advantages of embodiments of the invention will be apparent to those skilled in the art from the following detailed description of embodiments of the invention, when read with the drawings and appended claims.

DETAILED DESCRIPTION OF THE PREFERRED EMBODIMENTS

Figure 1A:
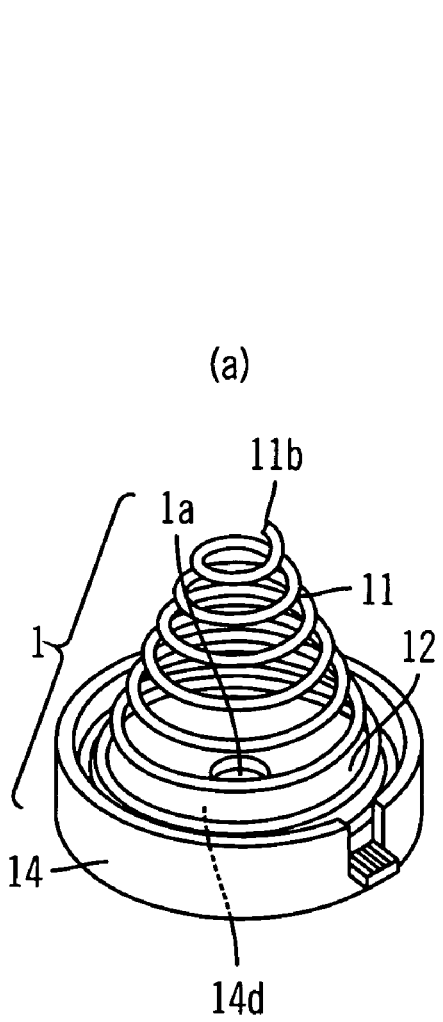
FIGS. 1*a* and 1*b* are oblique view drawings that show a first preferred embodiment of the displacement sensor of the present invention.

In the following description of preferred embodiments, reference is made to the accompanying drawings which form a part hereof, and in which is shown by way of illustration specific embodiments in which the invention may be practiced. It is to be understood that other embodiments may be utilized and structural changes may be made without departing from the scope of the preferred embodiments of the present invention.

An explanation will be given below regarding preferred embodiments of the present invention while referring to the drawings.

First, an explanation will be given regarding a first preferred embodiment of the present invention.

Figure 1B:
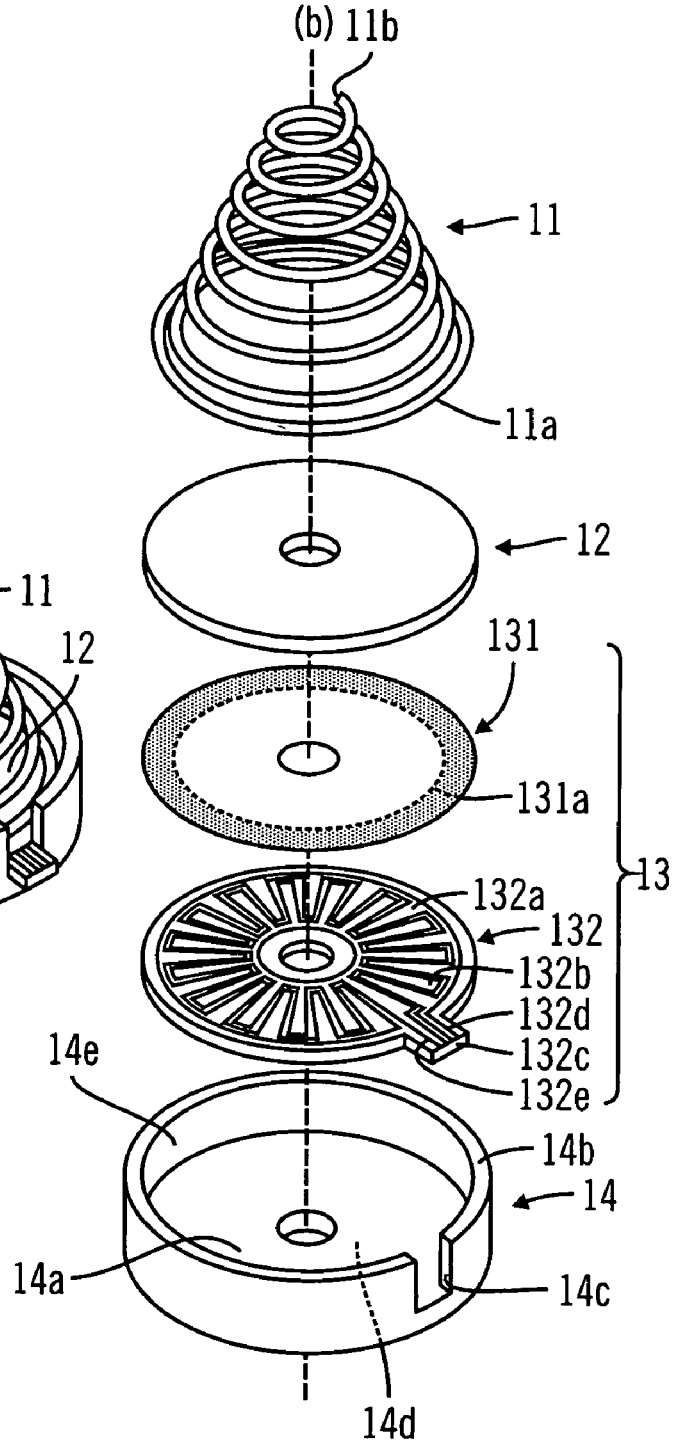

FIGS. 1(*a*) and 1(*b*) are oblique view drawings that show a first preferred embodiment of the displacement sensor of the present invention.

FIG. 1(*a*) is an exterior oblique view drawing seen from diagonally above the displacement sensor 1 and FIG. 1(*b*) is a disassembled oblique view drawing of the displacement sensor.

The displacement sensor 1 that is shown in FIGS. 1(*a*) and 1(*b*) comprises a conical coil spring 11, a circular cushion sheet 12, a sensor structure, such as circular sensor sheet section 13, and a fixing frame 14.

The fixing frame 14 has a cylindrical concave portion 14*e*.

The sensor sheet 13 is configured with resistive material, such as the circular printed resistor sheet 131, and a substrate having a conductive pattern, such as the circular printed carbon substrate 132, on which the circular printed resistor sheet is superposed. On the printed carbon substrate 132, there is a square shaped protuberant section 132*c* and this is arranged such that, when the printed resistor sheet 131 is superposed on the printed carbon substrate 132, the protuberant section 132*c* extends beyond the printed resistor sheet 131.

The printed resistor sheet 131 is made from a plastic and like materials, and a conductive ink such as carbon and the like is uniformly printed on the surface that faces the printed carbon substrate 132.

There is a spacer 131 a between the printed resistor sheet 131 and the printed carbon substrate 132, and it is arranged such that, when the two are superposed and the conical coil spring 11 is not compressed, there is no direct contact. The spacer 131*a* is in the shape of a ring and is placed on the peripheral edge section of the printed resistor sheet 131 facing the printed carbon substrate 132. Incidentally, the spacer 131*a* may also be disposed in the center section in addition to the peripheral edge section of the printed resistor sheet 131.

The printed carbon substrate 132 is a printed board on which two independent electrode patterns, the inner peripheral pattern 132*b* and the outer peripheral pattern 132*a*, which are formed with copper foil or other electrically conductive material, are disposed.

The inner peripheral pattern 132*b* comprises a ring shaped pattern that is disposed in the center of the substrate 132 and a branch form pattern that extends in a radial shape from the outer periphery of the ring shaped pattern toward the outer periphery of the substrate 132. In addition, in the midst of the branch form pattern, a linear pattern extends from the end section of the pattern that is located closest to the previously discussed protuberant section 132*c* to the protuberant section 132*c* and becomes the electrical terminal 132*e* of the inner peripheral pattern.

Also, carbon or another electrically conductive material is printed on the surface of the inner peripheral pattern 132*b*.

The outer peripheral pattern 132*a* comprises a ring shaped pattern that is disposed on the outer periphery of the substrate 132 and a branch form pattern that extends from the inner circumference of the ring shaped pattern toward the center of the substrate 132. The branch form pattern of the outer peripheral pattern 132*a* is disposed between the branch form pattern of the inner peripheral pattern 132*b* such that the former branch form pattern does not come into contact with the latter branch form pattern. The ring shaped pattern of the outer peripheral pattern 132*a* is disconnected in one place near the protuberant section 132*c* such that the pattern does not intersect with the terminal 132*e* of the inner peripheral pattern. The linear pattern extends to the protuberant section 132*c* from one end of this pattern that is disconnected and becomes the electrical terminal 132*d* of the outer peripheral pattern. In addition, carbon or another electrically conductive material is printed on the surface of the outer peripheral pattern 132*a* in the same manner as the inner peripheral pattern 132*b*.

The printed carbon substrate 132, the printed resistor sheet 131, and the cushion sheet 12 are received in the concave portion 14*e* of the fixing frame 14 in that order, the printed carbon substrate 132 received first. In addition, the conical coil spring 11 is set into the concave portion 14*e* of the fixing frame 14, the wider end 11*a* of the conical coil spring 11 first, and the wider end 11*a* of the conical coil spring 11 is in contact with the cushion sheet 12.

With regard to the protuberant section 132*c* of the printed carbon substrate 132, when the substrate 132 is accommodated in the fixing frame 14, the protuberant section 132*c* is set into the notched section 14*c* that is disposed in the outer wall of the fixing frame 14, and by this means, the rotation of the substrate 132 within the fixing frame 14 is prevented.

In the displacement sensor that is shown in FIG. 1(*a*), the attaching hole 1*a* is disposed in a position that is concentric with the axis of the conical coil spring 11. This attaching hole 1*a* is a hole that passes through all of the components that are shown in FIG. 1(*b*) in their accommodated state from top to bottom from the cushion sheet 12 through the fixing frame 14.

The displacement sensor 1 is used in order to detect, for example, the displacement of a pedal. In this case, the displacement sensor 1 is mounted in a position that is between the pedal and the facing bottom plate. In addition, the bottom surface of the displacement sensor 1 is in contact with the bottom plate and the front end section of the conical coil spring 11 is in contact with the pedal. When the pedal is stepped on, the displacement sensor 1 is subjected to a compression force from the tip section 11*b* of the conical coil spring 11. The conical coil spring 11 is compressed and changes shape due to this compression force.

One portion of the conical coil spring that has been compressed changes shape. This portion presses and impacts on the cushion sheet 12. A portion of the printed resistor sheet 131 that is below the cushion sheet 12 is pressed onto the printed carbon substrate 132.

An advantage of using a cushion sheet 12 made of a elastic material such as rubber is, when a pressing force is applied to the surface of the cushion sheet 12 at one point, the pressing force spreads and is also transmitted to the area around the one point to which it was applied.

Since the conical coil spring 11 presses the printed resistor sheet 131 onto the printed carbon substrate 132 through the cushion sheet 12, the force of the wire material of the conical coil spring on the printed resistor sheet 131 is made more uniform than if the sheet were directly pressed by the conical coil spring 11. The pressing force that has been made uniform is transmitted to the printed carbon substrate 132.

Due to the fact that a portion of the printed resistor sheet 131 is pressed onto the printed carbon substrate 132, the conductive ink that has been printed on the surface of the printed resistor sheet 131 and the carbon that has been printed on the surface of the inner peripheral pattern 132*b* and the outer peripheral pattern 132*a* of the printed carbon substrate 132 come into contact.

At this time, the current that flows in the outer peripheral pattern 132*a* passes through the carbon that has been printed on the surfaces of both patterns and the conductive ink that has been printed on the surface of the printed resistor sheet 131 and flows into the inner peripheral pattern 132*b*. Accordingly, the carbon and the conductive ink through which the current passes become an electrical resistance between both patterns.

When the pedal is stepped on further, the compression that is applied to the displacement sensor 1 increases and the compression shape change of the conical coil spring 11 becomes greater.

When the compression shape change becomes greater, the portions of the printed resistor sheet 131 that up to that point have not been in contact with the printed carbon substrate 132, are pressed onto the printed carbon substrate 132. As a result, the current also flows through the portions that have newly come into contact and, since the width of the path for the current that flows from the outer peripheral pattern 132*a* to the inner peripheral pattern 132*b* becomes broader, the electrical resistance between the two patterns decreases. The value of the electrical resistance is transmitted to, for example, the control section of the electronic musical instrument (not shown in the drawing) and the like as the amount that the pedal has been stepped on.

Figure 2A:
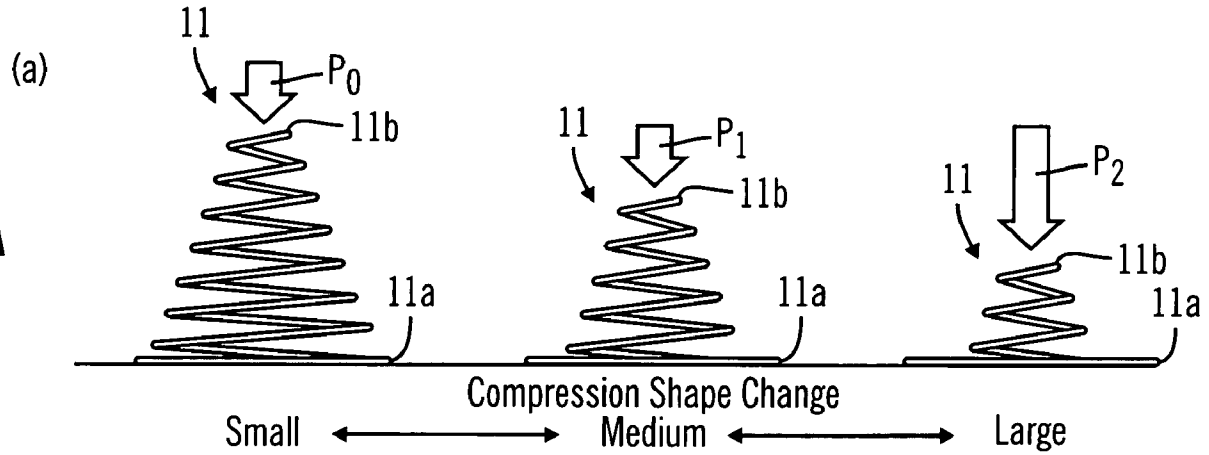
FIGS. 2*a* and 2*b* are drawings that shows the range in which, when the conical coil spring is compressed and changes shape, the printed resistor sheet is pressed and comes into contact with a substrate having a conductive pattern, such as a printed carbon substrate, due to the shape change.
Figure 2B:
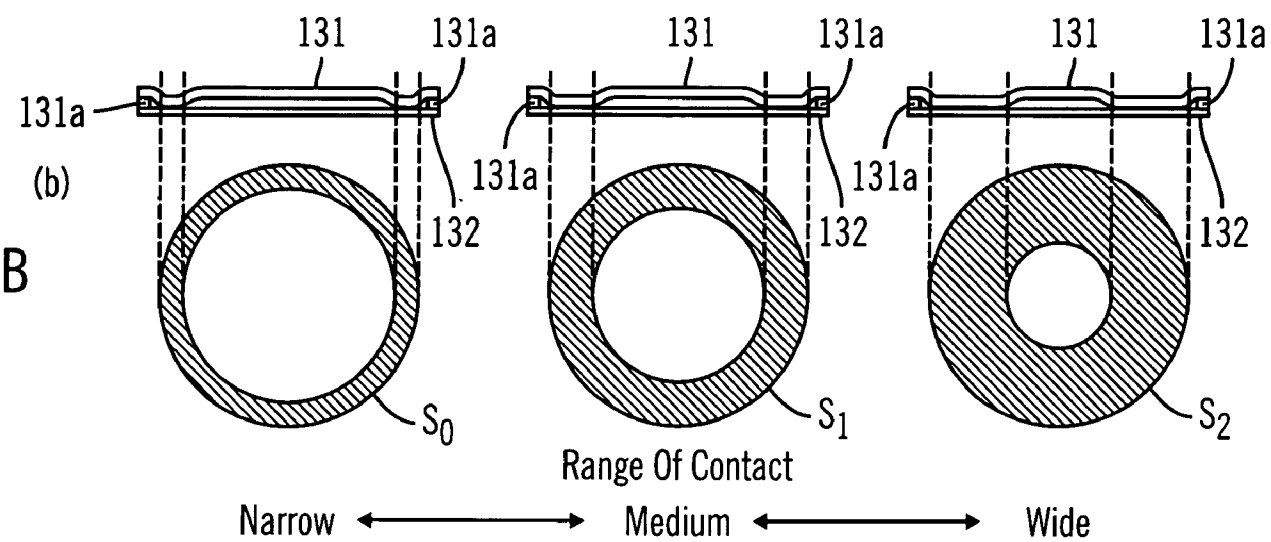

FIGS. 2*a* and 2*b* are drawings that show the range in which, when the conical coil spring 11 is compressed and changes shape, the printed resistor sheet 131 is pressed and comes into contact with the printed carbon substrate 132 due to the compression shape change.

When the displacement sensor 1 is subjected to the compression force to the tip section 11*b* of the conical coil spring 11 in a direction along the center axis of the conical coil spring 11, the conical coil spring 11 changes shape. As the conical coil spring 11 compresses, it presses and impacts on the cushion sheet 12 that is shown in FIG. 1.

FIG. 2(*a*) is a lateral drawing that shows the shape of the conical coil spring 11 when the spring is pressed weakly by a small compression force P0 that is applied to the tip section 11*b* of the conical coil spring 11, the shape of the conical coil spring 11 when the spring is pressed to a medium degree by a medium level compression force P1, and the shape of the conical coil spring 11 when the spring is pressed strongly by a large compression force P2.

FIG. 2(*b*) is a drawing that shows the range in which the printed resistor sheet 131, which had been isolated from the printed carbon substrate 132 by the spacer 131*a*, is pressed onto and comes into contact with the printed carbon substrate 132 by the conical coil spring that is shown in FIG. 2(*a*).

The S0 that is shown in FIG. 2(*b*) indicates the narrow range in which the printed resistor sheet 131 comes into contact with the printed carbon substrate 132 due to the conical coil spring 11 being pressed weakly by the small compression force P0. S1 indicates the medium range in which the printed resistor sheet 131 comes into contact with the printed carbon substrate 132 due to the conical coil spring 11 being pressed at a medium level by the compression force P1, and S2 indicates the wide range in which the printed resistor sheet 131 comes into contact with the printed carbon substrate 132 due to the conical coil spring 11 being pressed strongly by the large compression force P2.

Next, an explanation will be given of an example in which the displacement sensor 1 is used in order to detect the displacement of a pedal in the pedal system of an electronic musical instrument as a first utilization example of the present invention.

Figure 3:
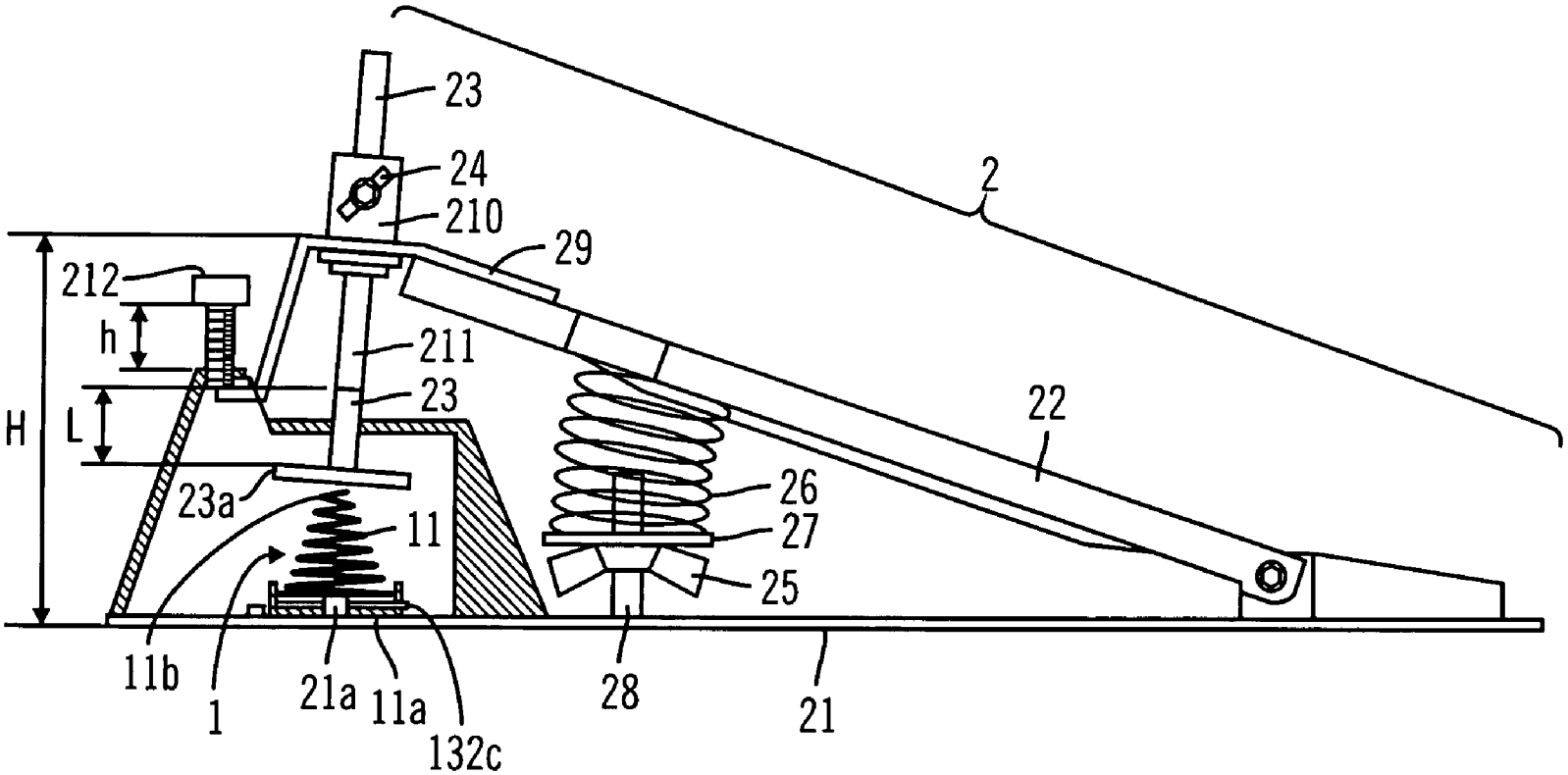
FIG. 3 is a lateral drawing that shows a partial cross-section of the state in which the displacement sensor has been mounted in the pedal system of an electronic musical instrument.

FIG. 3 is a lateral drawing that shows a partial cross-section of the state in which the displacement sensor 1 has been mounted in the pedal system 2 of an electronic musical instrument.

The pedal 22 of the pedal system 2 that is shown in FIG. 3 is supported by the bottom plate 21 so that it can swing and, together with this, is impelled upward by the compression coil spring 26 that has been disposed between the pedal 22 and the bottom plate 21. The upper end of the compression coil spring 26 is fixed to the back surface of the pedal 22, and the lower end of the compression coil spring 26 is supported through the intervening support plate 27 by the butterfly nut 25 that has been screwed onto the bolt 28 that has been disposed standing on the bottom plate 21. When the butterfly nut 25 is turned by hand, the butterfly nut 25 moves in the vertical direction and the degree of compression of the compression coil spring 26 is adjusted by means of the position of the butterfly nut 25, adjusting the operating weight of the pedal 22.

The lower part of the shaft that is shown in FIG. 3 passes through the pass-through hole (not shown in the drawing) that has been disposed in the shaft fixing block 210 which has been further fixed to the fixed plate 29 that has been fixed to the pedal 22, and the tube 211 that has been fixed to the lower surface of the shaft fixing block 210 and extends between the pedal 22 and the bottom plate 21. In addition, the upper part of the shaft 23 is linked to the controlled section of the electronic musical instrument-(not shown in the drawing) that is operated by the pedal system 2.

At this time, the displacement sensor 1 is mounted by being set in the pass-through hole 1*a* in the protuberant section 21*a* that has been disposed on the bottom plate 21 in a position that is opposite the plate 23*a* that is attached to the lower end of the shaft 23.

When the pedal 22 is stepped on, the plate 23*a* on the lower end of the shaft 23 presses downward and pushes on the tip section 11*b* of the conical coil spring 11 of the displacement sensor 1. Since the conical coil spring 11 that is pressed by the tip section 11*b* is compressed, the electrical resistance of the displacement sensor 1 changes. The value of the electrical resistance is transmitted to the control section of the electronic musical instrument (not shown in the drawing) as the amount that the pedal 22 of the pedal system 2 is stepped on.

The initial angle adjustment bolt 212 is furnished on the left part of the pedal system 2 of FIG. 3 and the fixed plate 29, which is fixed to the pedal 22, extends to the lower end of the initial angle adjustment bolt 212. The height H of the pedal 22 is adjusted by turning the initial angle adjustment bolt and changing the height h of the head of the bolt.

In addition, the shaft fixing bolt 24 is furnished in the shaft fixing block 210 that is shown in FIG. 3 and presses the shaft 23 that passes through from the side fixing the shaft 23. By changing the length L of the portion of the lower end of the shaft 23 that protrudes from the tube 211, the amount of change in the electrical resistance of the displacement sensor 1 with respect to the change in the amount that the pedal is stepped on is adjusted.

With the displacement sensors of the past, as one example, a rubber sensor is used on the portion that is compressed by the plate 23*a* on the lower end of the shaft 23, and when used continuously for a long period of time and repeatedly compressed, there is a problem that the shape of the rubber sensor itself becomes deformed and there is a danger that it will become impossible to accurately detect the amount that the pedal has been stepped on. However, with the embodiment of the displacement sensor 1 of the present invention, since a coil spring that is durable with respect to compression and changes in shape in conformance with the degree to which it is compressed is used, the sensor can be used for a long period of time compared to the displacement sensors of the past.

Next, an explanation will be given of an example of the use of the displacement sensor 1 to detect the displacement of the cymbals of an electronic high hat cymbal as a second utilization example of the present invention.

Figure 4:
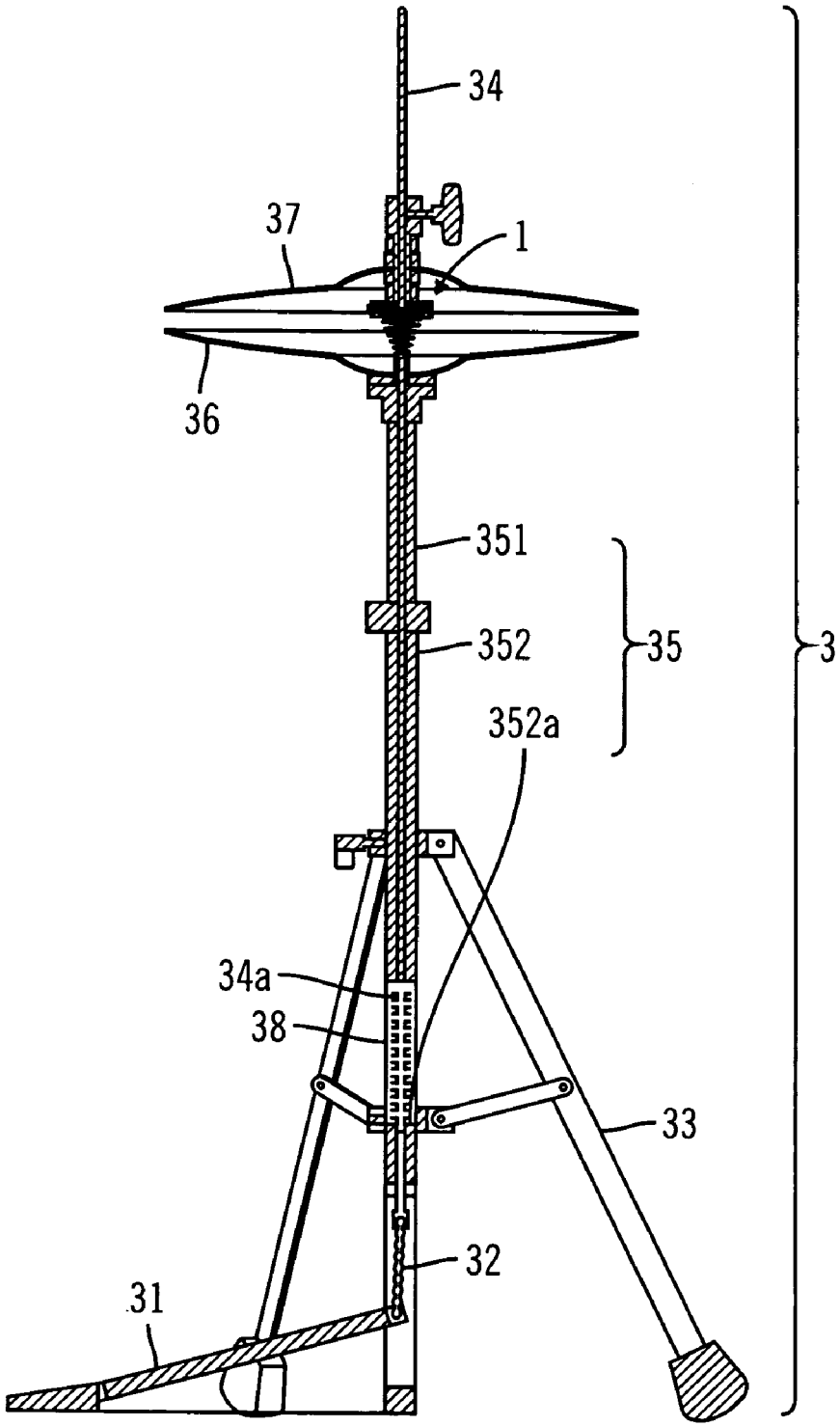
FIG. 4 is a lateral drawing that shows a partial cross-section of the state in which the displacement sensor has been mounted between the upper cymbal and the lower cymbal of an electronic high hat cymbal.

FIG. 4 is a lateral drawing that shows a partial cross-section of the state in which the displacement sensor 1 has been mounted between, for example, the upper cymbal 37 and the lower cymbal 36 of the electronic high hat cymbal 3.

The electronic high hat cymbal 3 is configured with the upper cymbal 37, the lower cymbal 36, the extension rod 34, which is linked to the upper cymbal, the hollow shaft section 35, which is linked to the lower cymbal, the spring 38, which is set into the inside lower end of the hollow shaft section 35, the stepping type pedal 31, the joint 32, which is linked to the extension rod 34 and the pedal 31, and the legs 33, which are linked to the hollow shaft section 35.

The upper part of the extension rod 34 is linked to the upper cymbal 37, the lower part is linked to the pedal 31 through the joint 32, and connecting and detaching is repeated from the upper part of the upper cymbal 37 in conformance with the stepping operation for the pedal 31. Incidentally, the linkage of the upper cymbal 37 to the extension rod 34 will be discussed later.

The hollow shaft section 35 comprises the upper hollow shaft 351 and the lower hollow shaft 352, which has an inside diameter that is greater that the outside diameter of the upper hollow shaft 351. The upper hollow shaft 351 is inserted into the lower hollow shaft 352 and the height of the lower cymbal 36 is determined by the depth to which the upper hollow shaft 351 is inserted into the lower hollow shaft. Incidentally, the joint section 352*a* is disposed on the lower end of the lower hollow shaft 352. The inside diameter of the joint section 352*a* is made somewhat narrow and supports the spring 38 that is set inside from the bottom.

The lower section of the extension rod 34 passes through the upper hollow shaft 351 and the lower hollow shaft 352 and, together with this, also passes through the spring 38 that has been set inside the lower hollow shaft 352. Since due to the fact that the spring 38 is held between the lower surface of the joint section 34a of the extension rod 34 and the joint section 352*a* of the lower hollow shaft 352, the extension rod 34 is always lifted upward, and when a stepping operation of the pedal 31 is not being carried out, the upper cymbal 37 and the lower cymbal 36 are separated at a prescribed interval.

Figure 5A:
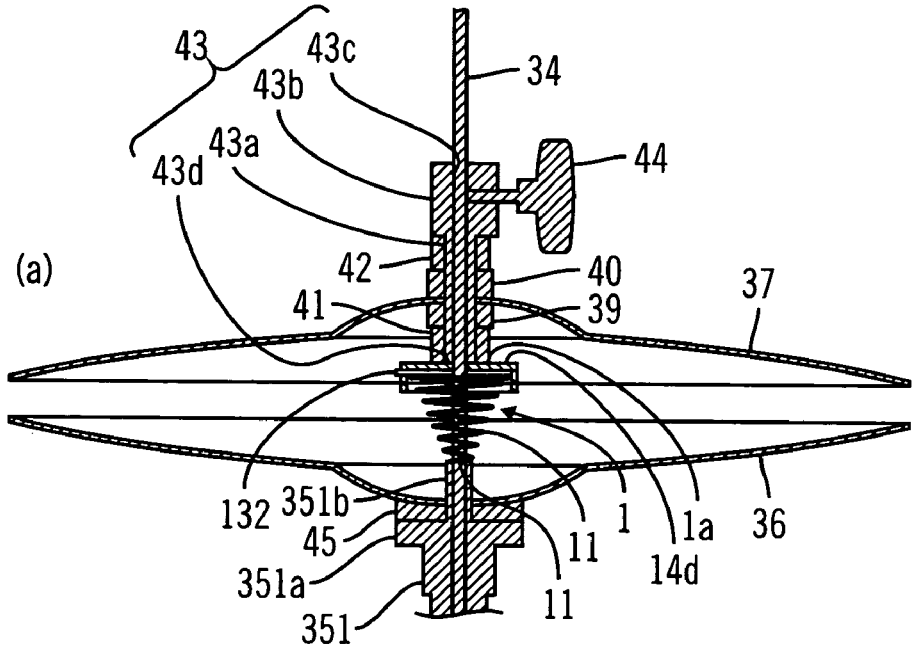
FIGS. 5*a* and 5*b* are lateral drawings that show an enlarged cross-section of the state in which the displacement sensor is mounted between the upper cymbal and the lower cymbal.
Figure 5B:
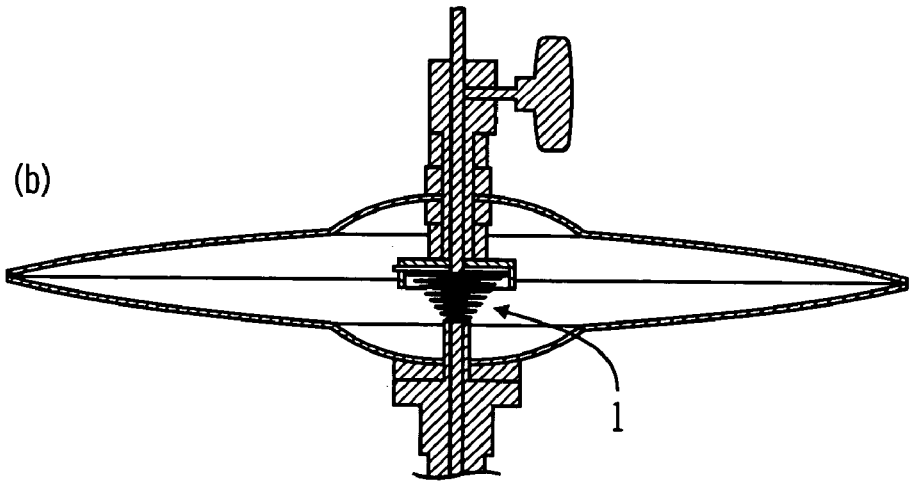

FIG. 5 is a lateral drawing that shows an enlarged cross-section of the state in which the displacement sensor 1 is mounted between the upper cymbal 37 and the lower cymbal 36.

FIG. 5(*a*) is a lateral drawing in which the separated state of the upper cymbal 37 and the lower cymbal 36 are shown in cross-section, and FIG. 5(*b*) is a lateral drawing that shows in cross-section the state in which, as a result of the upper cymbal 37 and the lower cymbal 36 having been brought into contact, the displacement sensor 1 is subjected to a compression force in the vertical direction, and the conical coil spring 11 of the displacement sensor 1 is compressed and changes shape. If the two cymbals are arranged in a different configuration, then the displacement sensor 1 may be subjected to a compression force in an accordingly different direction.

The upper felt washer 40, the lower felt washer 39, the upper nut 42, the lower nut 41, the fixing component 43, and the securing bolt 44, provided in order, link the upper cymbal 37 to the extension rod 34.

The fixing component 43 is formed with the lower bolt 43*a* extending on the lower surface of the upper block 43*b* and-the pass-through hole 43*c* is disposed in the center in order for the extension rod 34 to pass through. The upper nut 42 is screwed onto the lower bolt 43*a* of the fixing component 43 until the nut connects with and is stopped by the upper block 43*b* of the fixing component 43. The lower bolt 43*a* of the fixing component 43 is inserted through the pass-through holes that are disposed respectively in, from the bottom of the upper nut 42, the upper felt washer 40, the upper cymbal 37, and the lower felt washer 39. By additionally screwing the lower nut 41 onto the lower bolt 43*a* from the lower side of the lower felt washer 39, the upper cymbal 37 is fixed by the fixing component 43.

The tip section 351*b* of the upper hollow shaft 351 has the felt 45 held between the shaft bearer 351*a* and the lower cymbal 36 is supported from the bottom by the upper hollow shaft 351 by the insertion of the shaft into the pass-through hole that is disposed in the center of the lower cymbal 36.

The upper part of the extension rod 34 passes through center of the conical coil spring 11 of the displacement sensor 1 and the displacement sensor 1 attachment hole 1*a* at the upper part of the upper hollow shaft 351 that supports the lower cymbal 36 and additionally, passes through the pass-through hole 43*c* of the fixing component 43 with which the upper cymbal 37 is fixed. The tip section 11*b* of the conical coil spring 11 of the displacement sensor 1 is in contact with the tip section 351*b* of the upper hollow shaft 351, and the bottom surface 14*d* of the displacement sensor 1 is in contact with the lower end section 43*d* of the fixing component 43.

The upper block 43*b* of the fixing component 43 with which the upper cymbal 37 has been fixed is furnished with the securing bolt 44 that presses the extension rod 34 that passes through from the side and fixes the extension rod 34. The upper cymbal 37 is linked to the extension rod 34 through the fixing component 43 by means of the securing bolt 44.

When the upper cymbal 37, which is linked to the extension rod 34 by the fixing component 43, moves downward in conformance with the stepping on the pedal 31 that is shown in FIG. 4, the displacement sensor 1 is subjected to a compression force on the bottom surface 14*d* from the lower end section 43*d* of the fixing component 43 that moves as a single unit with the upper cymbal 37. On the other hand, since the tip section 11*b* of the conical coil spring 11, which lies on the other end of the displacement sensor 1, is in contact with the tip section 352*b* of the upper hollow shaft 351, which supports the lower cymbal 36, and does not move, the conical coil spring of the displacement sensor 1 is compressed by the compression force that has been applied to the bottom surface 14*d* of the displacement sensor 1. The electrical resistance of the displacement sensor 1 changes due to this compression. The value of the electrical resistance is transmitted to the control section of the electronic high hat cymbal (not shown in the drawing) as the amount of displacement of the upper cymbal 37 of the electronic high hat cymbal 3.

As has been explained above, the displacement of the upper cymbal in conformance with the stepping operation of the pedal 31 of the high hat cymbal 3 that is shown in FIG. 4 can be detected using the displacement sensor 1 of the present invention.

Incidentally, in those cases where the displacement sensor 1 is mounted on the electronic high hat cymbal 3, since it is possible to attach the electronic high hat cymbal 3 and the displacement sensor 1 to an ordinary acoustic high hat stand without the addition of any other special components, in those cases where the user already possesses an acoustic high hat, an acoustic high hat stand can be used. Then, it is possible to plan for a reduction of the mounting expense.

Next, an explanation will be given regarding a second preferred embodiment of the present invention.

Figure 6A:
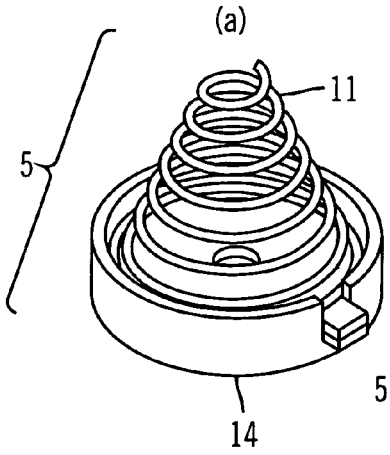
FIGS. 6*a* and 6*b* are oblique view drawing that show a second preferred embodiment of the displacement sensor of the present invention.
Figure 6B:
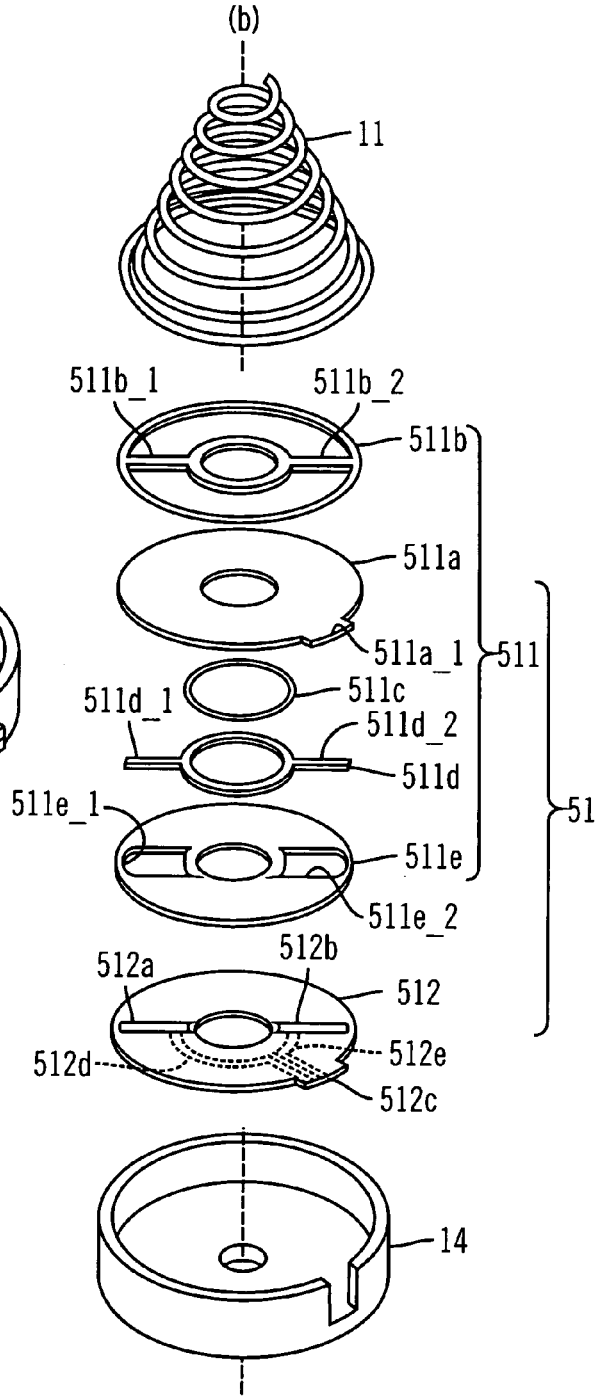

FIG. 6 is an oblique view drawing that shows a second preferred embodiment of the displacement sensor of the present invention.

FIG. 6(*a*) is an exterior oblique view drawing seen from diagonally above the displacement sensor 5 and FIG. 6(*b*) is a disassembled oblique view drawing of the displacement sensor 5. The displacement sensor 5 that is shown in FIG. 6 here is furnished with the same conical coil spring and fixing frame as the conical coil spring 11 and fixing frame 14 with which the displacement sensor 1 that is shown in FIG. I is furnished but is furnished with components between the conical coil spring and fixing frame that are different from the components that are furnished between the conical coil spring 11 and the fixing frame 14 of the displacement sensor 1 that is shown in FIG. 1. The displacement sensor 5, except for the areas in which the components with which the sensor is furnished differ from those of the displacement sensor 1 that is shown in FIG. 1, has a structure that is the same as that of the displacement sensor 1 that is shown in FIG. 1. Therefore, for the components that are the same as the components of the displacement sensor 1 that is shown in FIG. 1, (the conical coil spring 11 and the fixing frame 14), the same keys are assigned and shown in FIG. 6, and an explanation of these components and that duplicates a structure that is equivalent to that of the displacement sensor 1 that is shown in FIG. 1 has been omitted.

The displacement sensor 5 that is shown in FIG. 6 is furnished with the base film 511 and the substrate 512 between the conical coil spring 11 and the fixing frame 14. These two components comprise the sensor sheet 51.

The base film 511 and the substrate 512 respectively have the protuberant sections 511*a*_1 and 512*c* and, when the base film 511 and the substrate 512 are accommodated in the fixing frame 14, the protuberant sections 511*a*_1 and 512*c* are in a mutually superposed state set into the concave portion 14*e* of the fixing frame 14. Because of this, the base film 511 and the substrate 512 are prevented from turning in the fixing frame 14 and the relative positional relationships between the two are maintained.

The pressing film 511*b* is furnished with the two bridge sections 511*b*_1 and 511*b*_2 along the center line of the circular plastic sheet 511*a*. The pressing film 511*b*, which is affixed to the circular plastic sheet 511*a*, forms the thick convex portion of the pressing film 511*b* on the conical coil spring 11 side surface of the base film 511. When the conical coil spring 11 is compressed, a portion of the conical coil spring 11 pushes and impacts particularly strongly against the two bridge sections 511*b*_1 and 511*b*_2 and, as a result, the area below the portion of these two bridge sections 511*b*_1 and 511*b*_2 of the base film 511 that is pressed and impacted by the conical coil spring 11 is pressed strongly on the substrate 512.

The conductive pattern 511*c* is printed with a conductive ink such as carbon and the like on the substrate 512 side surface of the plastic sheet 511*a* and is a ring shaped pattern that surrounds the attachment hole 1*a* of the displacement sensor 5.

The resistive pattern 511*d* is a pattern in which a resistive material such as carbon and the like is printed superposed on the conductive pattern 511*c* described above on the substrate 512 side surface of the plastic sheet 511*a*. The resistive pattern 511*d* is furnished with the branch shaped patterns 511*d*_1 and 511*d*_2 that faces the outer edge of the plastic sheet 511*a* from the ring shaped pattern that is superposed on the conductive pattern 511*c* under the two bridge sections 511*b*_1 and 511*b*_2 of the pressing film 511*b*. When the conical coil spring 11 is compressed, a portion of each of the two branch shaped patterns 511*d*_1 and 511*d*_2 is pressed onto the substrate 512 through the above mentioned two bridge sections 511*b*_1 and 511*b*_2.

The spacer film 511*e* is affixed on the resistive pattern 511*d* on the substrate 512 side surface of the plastic sheet 511*a*. The two openings 511*e*_1 and 511*e*_2 are disposed in two locations in positions that correspond to the two branch shaped patterns 511*d*_1 and 511*d*_2 of the resistive pattern 511*d* described above. When the conical coil spring is compressed, the two branch shaped patterns 511*d*_1 and 511*d*_2 are pressed onto the substrate 512 through the openings 511*e*_1 and 511*e*_2 in the two corresponding locations. However, it should be noted that, in a state in which the conical coil spring 11 is not compressed, the two branch shaped patterns 511*d*_1 and 511*d*_2 described above are separated from the substrate only by the thickness of the spacer film 511*e*.

The substrate 512 is configured with a circular base material on which a metal pattern is disposed on both sides. On the spacer film 511*e* side obverse surface, the two metal patterns 512*a* and 512*b*, which are mutually independent, are disposed in positions that correspond respectively to the two branch shaped patterns 511*d*_1 and 511*d*_2 of the resistive pattern 511*d*. On the other hand, on the reverse surface, the two terminal patterns 512*d* and 512*e*, which extend to the protuberant section 512*c* of the substrate 512 and form electrical terminals on the protuberant section 512*c*, are disposed respectively below the two branch shaped patterns 511*d*_1 and 511*d*_2 described above. In addition, the two branch shaped patterns 511*d*_1 and 511*d*_2 described above are respectively conducted through by through holes not shown in the drawing to the corresponding terminal patterns 512*d* and 512*e*. When the conical coil spring 11 is compressed, a portion of each of the two branch shaped patterns 511*d*_1 and 511*d*_2 described above comes into contact respectively with the corresponding metal pattern 512*a* and 512*b*.

In the same manner as the displacement sensor of the first preferred embodiment discussed previously, the displacement sensor 5 of the second preferred embodiment also is used, for example, in order to detect the displacement of a pedal and the like. In this case, when the conical coil spring 11 is compressed by stepping on the pedal, as was discussed above, a portion of the resistive pattern 511*d* of the base film 511 comes into contact with the metal patterns 512*a* and 512*b* on the obverse surface of the substrate 512. At this time, when the current is conducted through the metal patterns 512*a* and 512*b* and flows between the terminal patterns 512*d* and 512*e* on the reverse surface of the substrate 512, the current flows passing through the resistive pattern 511*d* described above, the ring shaped pattern on the resistive pattern 511*d*, and the conductive pattern 511*c* described above that is printed on the plastic sheet 511*a* on which the patterns are superposed. Accordingly, the resistive pattern 511*d* and the conductive pattern 511*c* through which the current passes become an electrical resistance between the terminal patterns 512*d* and 512*e*.

Figure 7:
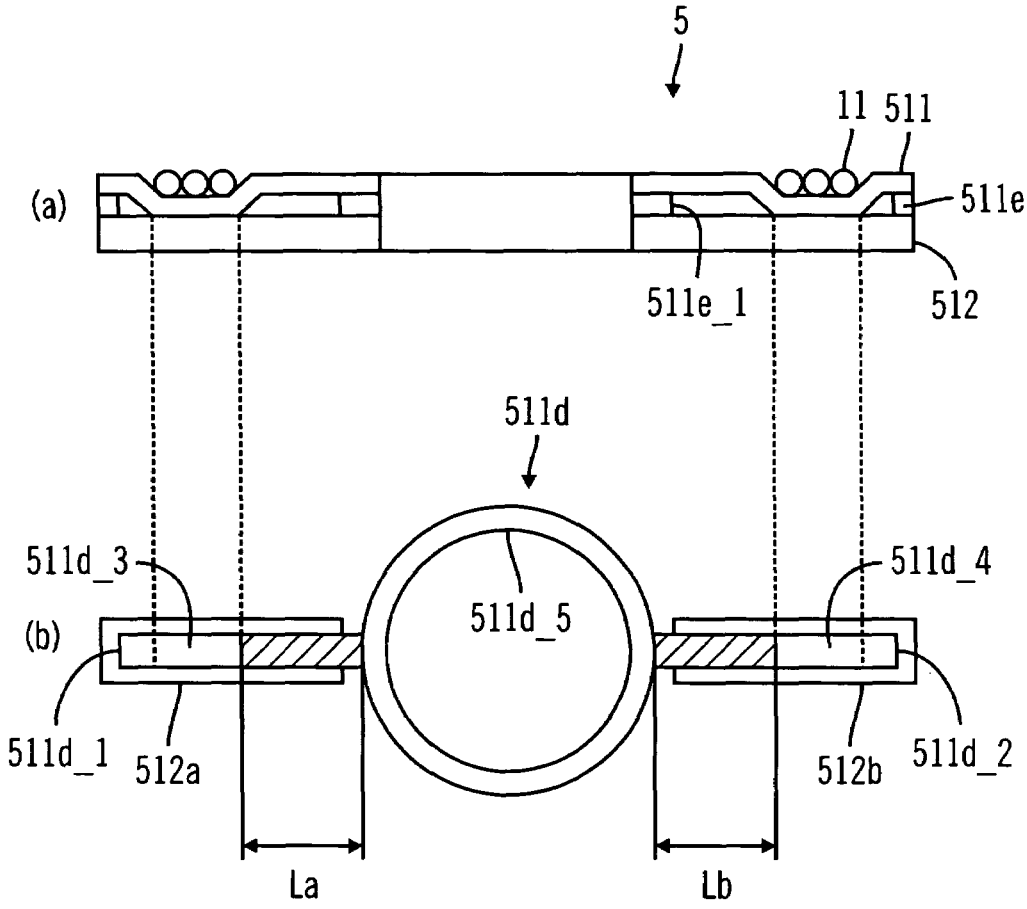
FIGS. 7*a* and 7*b* are schematic drawings that show the state in which a portion of the resistive pattern of the base film has come into contact with the metal pattern on the obverse surface of the substrate.

FIGS. 7(*a*) and 7(*b*) are schematic drawings that show the state in which a portion of the resistive pattern of the base film has come into contact with the metal pattern on the obverse surface of the substrate.

In FIG. 7(*a*), the condition is shown in which, in a case in which the displacement sensor 5 is utilized to detect the displacement of, for example, a pedal and the like, the conical coil spring 11 is compressed by the pedal being stepped on, the base film 511 is pushed and impacted on by a portion of the conical coil spring 11 and, in addition, a portion of the base film 511 is pushed and impacted on by the obverse side of the substrate 511 through the openings 511*e*_1 and 511*e*_2 of the spacer film 511*e*. By this means, as was discussed above, a portion of the resistive pattern 511*d* comes into contact with the metal patterns 512*a* and 512*b* on the obverse surface of the substrate 512.

In FIG. 7(*b*), the two metal patterns 512*a* and 512*b* on the obverse surface of the substrate 512 and the resistive pattern 511*d*, which is in contact with these metal patterns 512*a* and 512*b*, are shown. As discussed above, when the base film 511 is pushed and impacted on by the substrate 512, a portion of each of the branch shaped patterns 511*d*_1 and 511*d*_2 of the resistive pattern 511*d* come into contact, respectively, with the corresponding metal patterns 512*a* and 512*b*. In addition, the portions of the resistive pattern 511*d* that are in between these two locations (excluding 511*d*_5), the contact portions 511*d*_3 and 512*d*_4, which are indicated by the diagonal lines in FIG. 7(*b*), and the conductive pattern 511*c* become an electrical resistance between the metal patterns 512*a* and 512*b* as well as between the terminal patterns 512*d* and 512*e* that are shown in FIG. 6.

When the pedal described above is stepped on further and the conical coil spring 11 is further compressed, the portions of the resistive pattern 511*d* that, up to this point, have not been in contact with the metal patterns 512*a* and 512*b* also are pressed on by the metal patterns 512*a* and 512*b*. As a result, the distance La+Lb between the two locations described above, the contacted portions 511*d*_3 and 511*d*_4, is shortened and the value of the electrical resistance described above is reduced.

Figure 8:
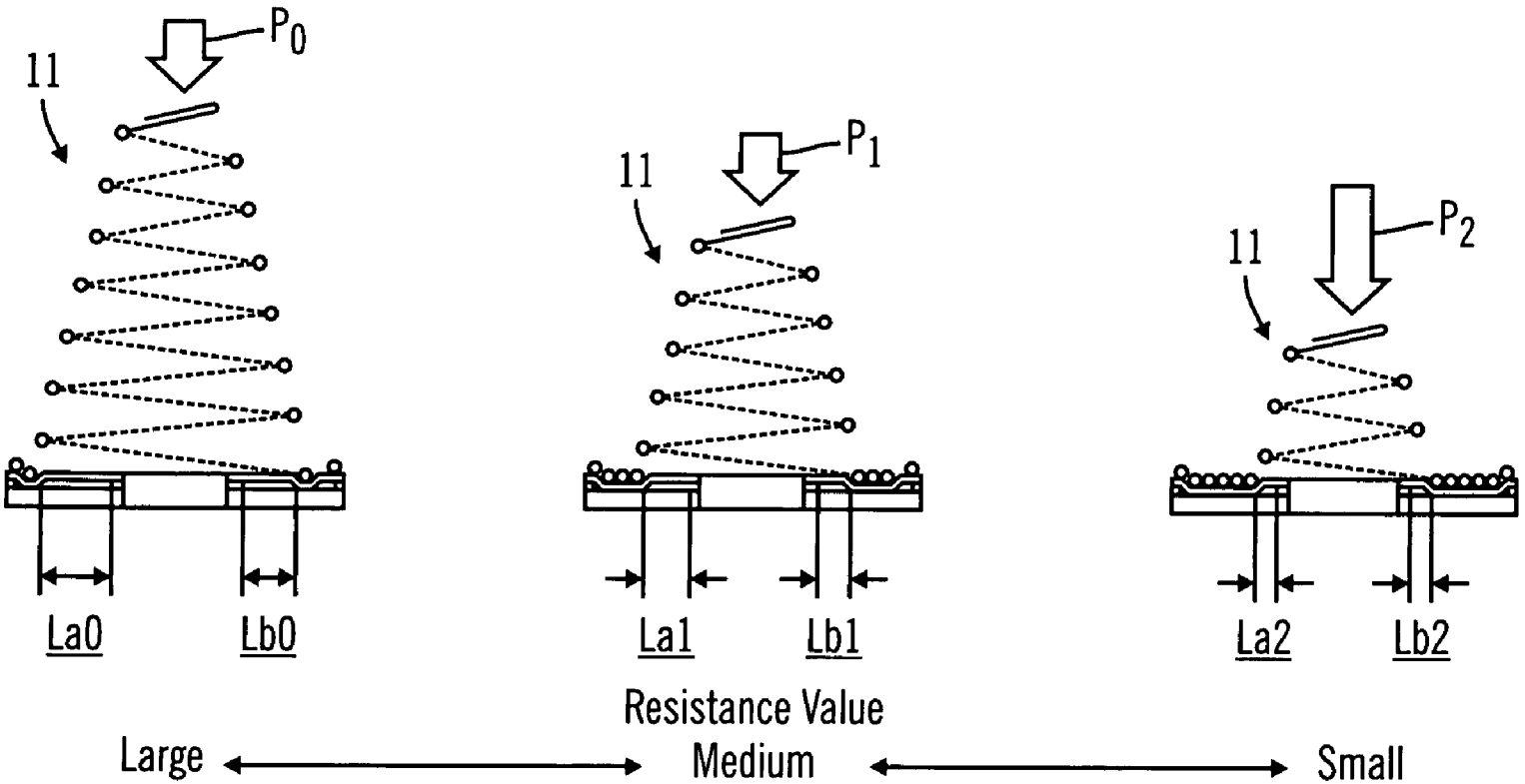
FIG. 8 is a drawing that shows the change in the distance between the contacted portions of the two locations shown in FIG. 7 that accompanies the increase in the portion of the conical coil spring that is pushed and impacted on by the base film.

FIG. 8 is a drawing that shows the change in the distance between the contacted portions of the two locations shown in FIG. 7 that accompanies the increase in the portion of the conical coil spring that is pushed and impacts on the base film.

In FIG. 8, the condition in which the conical coil spring 11 is weakly pressed with a small compression force P0 and the base film is slightly pushed and impacted on by the conical coil spring 11 is shown. At this time, the portion that corresponds to the long distance La0+Lb0 between the contacted portions described above of the resistive pattern 511*d* (refer to FIG. 7) becomes the electrical resistance between the terminal patterns 512*d* and 512*e* that are shown in FIG. 6 and the value of the electrical resistance is large. In addition, when the compression force that is applied to the conical coil spring 11 is increased and becomes the medium level compression force P1, the base film is pushed and impacted on to a medium degree by the conical coil spring 11 and the value of the electrical resistance described above becomes a medium level value that is proportional to the medium level distance La1+Lb1 shown in FIG. 8. When the compression force that is applied to the conical coil spring 11 is increased and becomes the large compression force P2, a larger portion of the base film is pushed and impacted on by the conical coil spring 11 and the value of the electrical resistance described above becomes a small value that is proportional to the short distance La2+Lb2 shown in FIG. 8.

That is to say, when the displacement of a pedal such as that discussed above is detected by means of the utilization of the displacement sensor 5, in the same manner as in the first preferred embodiment discussed previously, the value of the electrical resistance is transmitted to, for example, the control section of the electronic musical instrument (not shown in the drawing) and the like as the amount that the pedal has been stepped on.

The second preferred embodiment, in the same manner as in the first preferred embodiment discussed previously, is utilized to detect the displacement of the pedal of the pedal system 2 of an electronic musical instrument shown in FIG. 3 or to detect the displacement of the cymbal in the electronic high hat cymbal 3 shown in FIG. 4 and FIG. 5 and the like. However, with regard to these kinds of utilization embodiments for the second preferred embodiment described above, since they are the same as the utilization embodiments of the first preferred embodiment for which explanations were given referring to FIG. 3 through FIG. 5, the duplicated explanations have been omitted.

In addition, as has been discussed previously, by means of the first preferred embodiment, advantageous results are that durability is increased with the use of a coil spring and that, when the displacement sensor 1 is installed in the electronic high hat cymbal 3 that is shown in FIG. 4, the installation expenses are reduced. It need scarcely be said that advantageous results that are the same as these advantageous results can also be obtained by means of the displacement sensor 5 of the second preferred embodiment of the present invention.

Incidentally, in the above preferred embodiments, as illustrations of the sensor sheet of the present invention, an example in which a printed carbon substrate 132 and a printed resistor sheet 131 having as conductive ink such as carbon and the like printed uniformly on a strong plastic sheet such as polyester have been combined, and an example in which a substrate 512 having metal patterns disposed on both surfaces and a base film 511 having a resistive pattern 511*d* printed on a plastic sheet have been combined were given. However, the sensor sheet in the embodiments of the present invention is not limited to these examples and, for example, a pressure sensitive printed resistor sheet in which the resistance value changes in accordance with the pressing force and the like may be used.

What is claimed is:

1. A sensor device comprising:

a sensor sheet having a surface area and providing electrical resistance having a value, the value of the electrical resistance changing with the surface area of the sensor sheet that is pressed; and a coil spring having a conical shape with a wider end, the wider end of the coil spring disposed opposite to the sensor sheet such that the coil spring presses an increasing surface area of the sensor sheet as the coil spring is compressed.

2. The sensor device as recited in claim 1, the sensor sheet of the sensor device further comprising:

a sheet material providing electrical conductivity; and an electrode pattern that is disposed opposite the sheet material and is formed in a radial shape from a center of the pattern toward a peripheral edge of the pattern.

3. A sensor device for detecting displacement of a movable object, comprising:

a member providing a detectable electrical characteristic that has a value; and a spring that, upon displacement of the movable object, is compressed and acts with the member providing the detectable electrical characteristic;

wherein action between the spring and the member providing the detectable electrical characteristic causes the value of the electrical characteristic to change.

4. The sensor device as recited in claim 3, wherein the member providing the detectable electrical characteristic has the shape of a sheet.

5. The sensor device as recited in claim 3, wherein the value of the electrical characteristic represents an amount of displacement of the movable object and is input to a controller of a musical instrument that produces a sound signal dependent, at least in part, on the value of the electrical characteristic.

6. The sensor device as recited in claim 3, wherein the spring is a coil spring.

7. The sensor device as recited in claim 3, wherein the spring is a coil spring that has a conical shape.

8. The sensor device as recited in claim 3, wherein the spring and the member providing the detectable electrical characteristic are contained within a frame.

9. The sensor device as recited in claim 3, wherein the spring and the member providing the detectable electrical characteristic are contained within a cylindrical frame that has a concave end surface; and the frame is notched to receive a protuberant section of the member providing the detectable electrical characteristic.

10. The sensor device as recited in claim 3, wherein an elastic member is disposed between the spring and the member providing the detectable electrical characteristic to convey a force from the spring to the member providing the detectable electrical characteristic.

11. The sensor device as recited in claim 3, wherein a member that distributes force of the action between the spring and the member providing the detectable electrical characteristic is disposed between the spring and the member providing the detectable electrical characteristic.

12. The sensor device as recited in claim 3, wherein the member providing the detectable electrical characteristic comprises:

a first member having at least one surface that is electrically conductive;

a second member having a center region, a peripheral region, and at least two electronically independent nodes; and a third member disposed between the first member and the second member that limits electrical conductance via the at least one surface of the first member between the at least two electronically independent nodes of the second member when the spring is in a first state of compression and that facilitates electrical conductance via the at least one surface of the first member between the at least two electronically independent nodes of the second member when the spring is in a second state of compression;

wherein the spring is compressed to a greater degree when the spring is in the second state of compression relative to when the spring is in the first state of compression.

13. The sensor device as recited in claim 12, wherein in the first state of compression the spring is uncompressed.

14. The sensor device as recited in claim 12, wherein:

the electrical characteristic is an electrical resistance; and the electrical resistance changes with displacement of the movable object, which changes a degree to which the spring is compressed.

15. The sensor device as recited in claim 14, wherein the degree to which the spring is compressed changes a degree to which the at least one surface of the first member provides electrical conductance between the at least two electronically independent nodes of the second member.

16. The sensor device as recited in claim 12, wherein one of the at least two electronically independent nodes of the second member comprises a connected series of radial segments disposed between the center region of the second member and the peripheral region of the second member.

17. The sensor device as recited in claim 3, wherein:

the spring has an axis, through which the spring is compressed upon the displacement of the movable object; and the member providing the detectable electrical characteristic has a hole that is concentric with the axis of the spring.

18. The sensor device as recited in claim 17, wherein the hole in the member providing the detectable electrical characteristic receives a shaft disposed through the axis of the spring.

19. The sensor device as recited in claim 3, wherein:

the spring is a coil spring composed of a spring material having a length arranged in multiple loops; and upon compression of the spring, one or more of the multiple loops engage the member providing the detectable electrical characteristic such that the length of the spring material engaging the member providing the detectable electrical characteristic changes with an amount of compression of the spring.

20. A method of making a displacement detector, comprising:

providing a member having a detectable electrical characteristic that has a value;

disposing a spring opposite to the member having a detectable electrical characteristic; and disposing a movable object relative to the spring to compress the spring and cause the spring to act with the member having the detectable electrical characteristic upon displacement of the movable object, wherein action between the spring and the member having the detectable electrical characteristic causes the value of the electrical characteristic to change.

21. The method as recited in claim 20, wherein the spring is a coil spring.

22. The method as recited in claim 20, wherein the spring is a coil spring in a conical shape.

23. The method as recited in claim 20, wherein providing the member having the detectable electrical characteristic comprises:

providing a first member having at least one surface that is electrically conductive;

providing a second member having a center region, a peripheral region, and at least two electronically independent nodes; and disposing a third member between the first member and the second member that limits electrical conductance via the at least one surface of the first member between the at least two electronically independent nodes of the second member when the spring is in a first state of compression and that facilitates electrical conductance via the at least one surface of the first member between the at least two electronically independent nodes of the second member when the spring is in a second state of compression;

wherein the spring is compressed to a greater degree when the spring is in the second state of compression relative to when the spring is in the first state of compression.

24. The method as recited in claim 23, wherein in the first state of compression the spring is uncompressed.

25. The method as recited in claim 23, wherein:

the electrical characteristic is an electrical resistance; and the electrical resistance changes with displacement of the movable object, which changes a degree to which the spring is compressed.

26. The method as recited in claim 23, wherein a degree to which the spring is compressed changes a degree to which the at least one electrically conductive surface of the first member provides electrical conductance between the at least two electronically independent nodes of the second member.

27. The method as recited in claim 23, wherein:

the spring is a coil spring composed of a spring material having a length arranged in multiple loops; and upon compression of the spring, one or more of the multiple loops engage the member having the detectable electrical characteristic such that the length of the spring material engaging the member providing the detectable electrical characteristic changes with an amount of compression of the spring.

* * * * *